US005354177A

United States Patent [19]

Chang

[11] Patent Number: 5,354,177

[45] Date of Patent: Oct. 11, 1994

[54] FAN

[76] Inventor: Song H. Chang, No. 23, Lane 420, Min An Rd., Hsin Chuang City, Taipei Hsien, Taiwan

[21] Appl. No.: 159,811

[22] Filed: Nov. 30, 1993

[51] Int. Cl.[5] ..... F01D 5/30

[52] U.S. Cl. ..... 416/219 A; 416/220 A; 416/241 A

[58] Field of Search ..... 416/219 A, 220 A, 241 A, 416/93 A

[56] References Cited

U.S. PATENT DOCUMENTS

| | | | |
|---|---|---|---|
| 612,598 | 10/1898 | Wanless | 416/220 A |
| 3,332,500 | 7/1967 | Bristol et al. | 416/220 A |
| 3,751,181 | 8/1973 | Hayashi | 416/241 A |
| 4,566,855 | 1/1986 | Costabile et al. | 416/93 A |
| 4,930,987 | 6/1990 | Stahl | 416/219 A |

FOREIGN PATENT DOCUMENTS

| | | | |
|---|---|---|---|
| 2203527 | 8/1973 | Fed. Rep. of Germany | 416/241 A |
| 0030501 | 3/1933 | Netherlands | 416/220 A |
| 2201198 | 8/1988 | United Kingdom | 416/93 A |

*Primary Examiner*—Edward K. Look
*Assistant Examiner*—Christopher Verdier
*Attorney, Agent, or Firm*—Welsh & Katz, Ltd.

[57] ABSTRACT

A plastic fan with several fins attached to a hub. The fins are formed in a mold in order to reduce the difference between themselves to a minimum. The fins are attached to the hub so that each of them is retained at an angle from the adjacent one. The fan so produced is well balanced during rotation. Each fin has a male engaging device which is engaged in a female engaging device formed in the hub. The fins are welded to the hub by ultrasonic waves.

5 Claims, 5 Drawing Sheets

FAN

BACKGROUND OF INVENTION

The present invention relates to a plastic fan which has several fins attached to a hub. The fins are formed in a mold by plastic injection so as to reduce the difference between them to a minimum.

Conventionally, each plastic fan is an integral unit which has several fins radially projecting from a hub. Such a plastic fan is formed in a mold which has a central portion wherein the hub is molded and several peripheral portions wherein the fins are formed. The fins so produced have a considerable difference between themselves. A fan so produced will not be balanced during rotation, thus causing vibration and noise. Moreover, the mold is disposed in a way that the hub of the mold is disposed horizontally, i.e., some peripheral portions of the mold are retained on a level higher than the remaining peripheral portions of the mold. The fins which are formed in the lower peripheral portions of the mold weigh more than the fins which are formed in the higher peripheral portions of the mold. The fan so produced will not be balanced during rotation, thus causing vibration and noise.

SUMMARY OF INVENTION

It is the primary object of the present invention to provide a fan which is well balanced during rotation.

The primary object of the present invention is achieved by a fan which has several fins attached to a hub. The fins are formed in a mold so as to reduce the difference between the fins to a minimum. The fins are attached to the hub so that each of them is retained at an angle from the adjacent one. The fan so produced is well balanced during rotation.

For a better understanding of the present invention and objects thereof, a study of the detailed description of the embodiments described hereinafter should be made in relation to the accompanying drawings.

DETAILED DESCRIPTION OF PREFERRED EMBODIMENT

Figure 1:
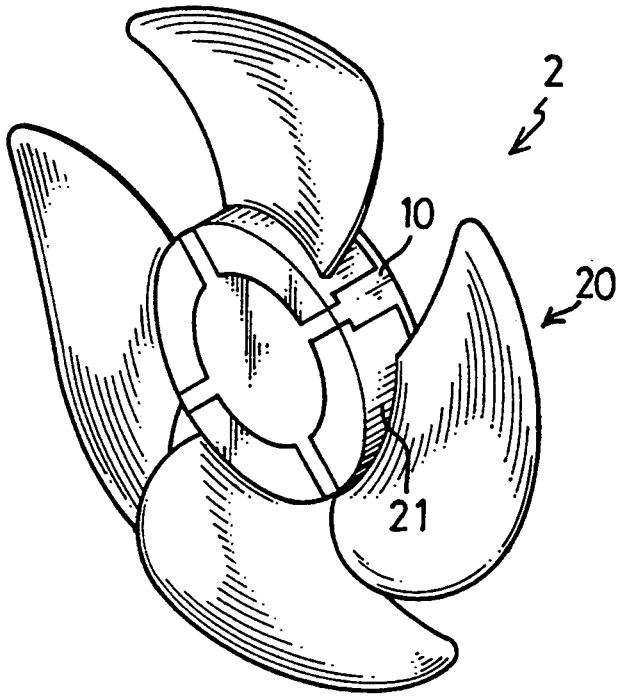
FIG. 1 is a perspective view of a fan in accordance with a first embodiment of the present invention.

Referring to FIG. 1, according to a first embodiment of the present invention, a plastic fan 2 has four plastic fins 20 attached to a plastic hub 10 so that each of them is retained at an angle from the adjacent one. The fins 20 are formed in a mold (not shown) in order to reduce the difference between themselves to a minimum. The fan 2 is well balanced during rotation. A male engaging device (not shown) is formed on each fin 20. Four female engaging devices are formed in the hub 10. The male engaging device (not shown) formed on each fin 20 is engaged in a corresponding female engaging device formed in the hub 10. The fins 20 are welded to the hub 10 by ultrasonic waves.

Figure 2:
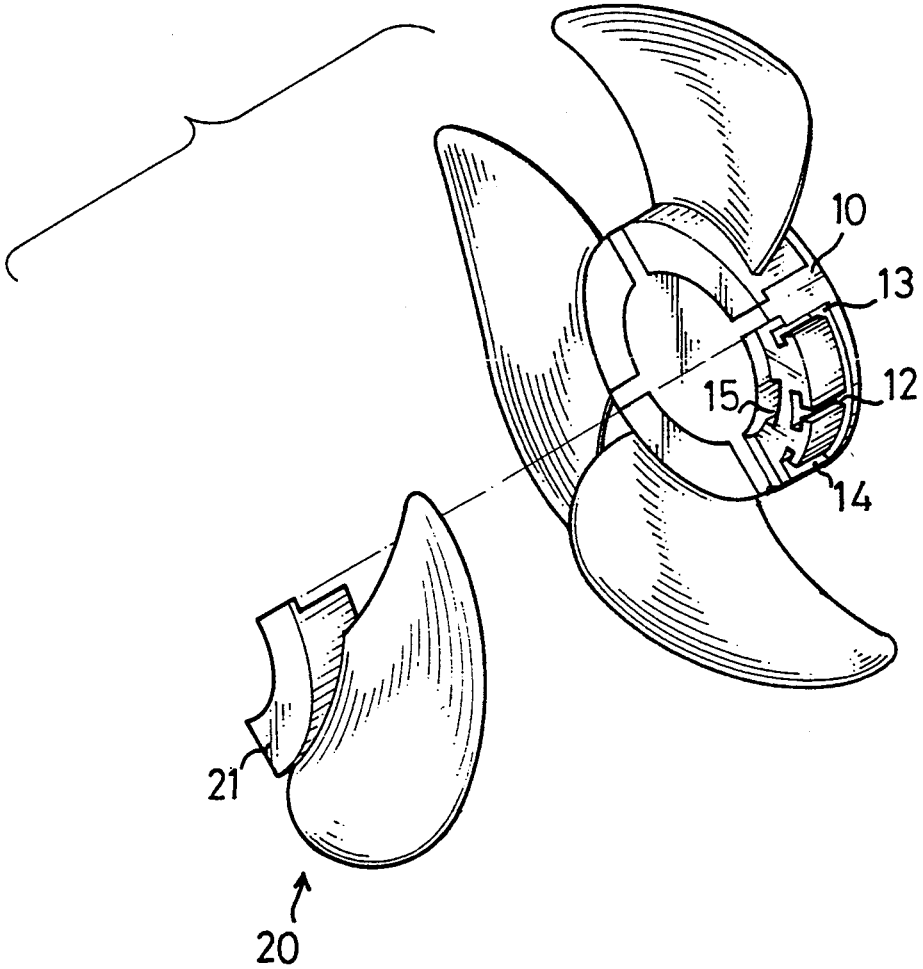
FIG. 2 is an exploded view of a fan in accordance with the first embodiment of the present invention.

Referring to FIG. 2, each female engaging device has a T-shaped slot 12 formed in the hub 10 and two L-shaped slots 13 and 14 formed in the hub 10. The L-shaped slot 13 has a first portion extending in a radius and a second portion perpendicularly extending from the first portion-thereof. The L-shaped slot 14 has a first portion extending in a radius and a second portion perpendicularly extending from the first portion thereof. The second portion of the L-shaped slot 13 and the second portion of the L-shaped slot 14 extend toward each other. A recess 15 is formed in the hub 10.

Figure 3:
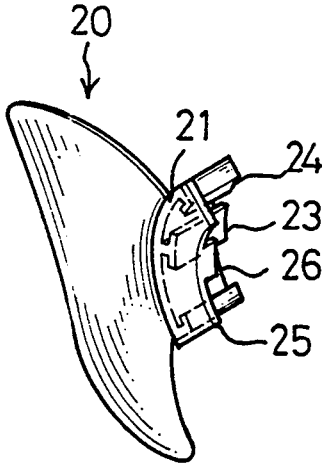
FIG. 3 is a perspective view of a fin in accordance with the first embodiment of the present invention.

Referring to FIG. 3, the male engaging device of each fin 20 has an arcuate wall formed on a side of each fin 20 and a flange 21 formed on an arcuate edge of the arcuate wall. A T-shaped slide 23 and two L-shaped slides 24 and 25 are formed on the arcuate wall. A tab 26 is formed on the flange 21.

Figure 4:
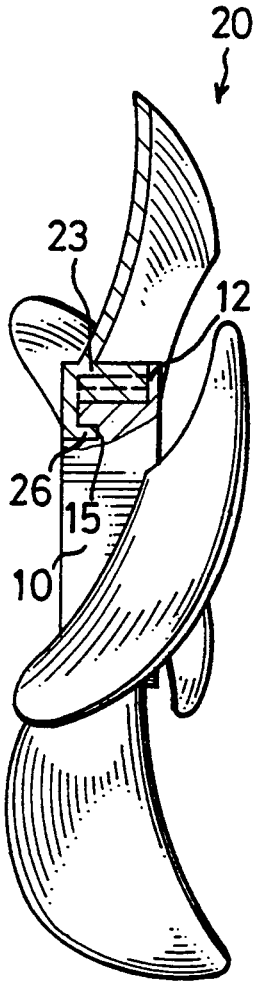
FIG. 4 is a side view of a fan in accordance with the first embodiment or the present invention which is partly cut away so as to show the engagement of a fin with the hub.

The T-shaped slide 23 is engaged in the T-shaped slot 12, the L-shaped slide 24 is engaged in the L-shaped slot 14, the L-shaped slide 25 is engaged in the L-shaped slot 13, the tab 26 is engaged in the recess 15 (see FIG. 4), so that each fin 20 is attached to the hub 10. The fins 20 are welded to the hub 10 by ultrasonic waves in order to keep the fins 20 from being detached from the hub 10 during rotation.

Figure 6:
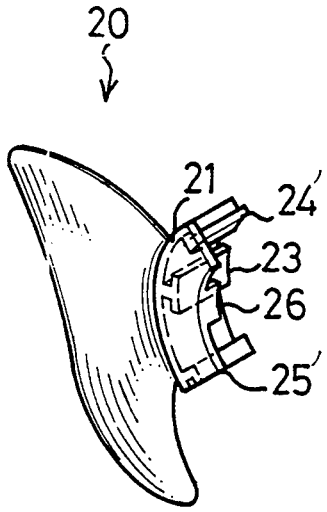
FIG. 6 is a perspective view of a fin in accordance with the second embodiment of the present invention.
Figure 5:
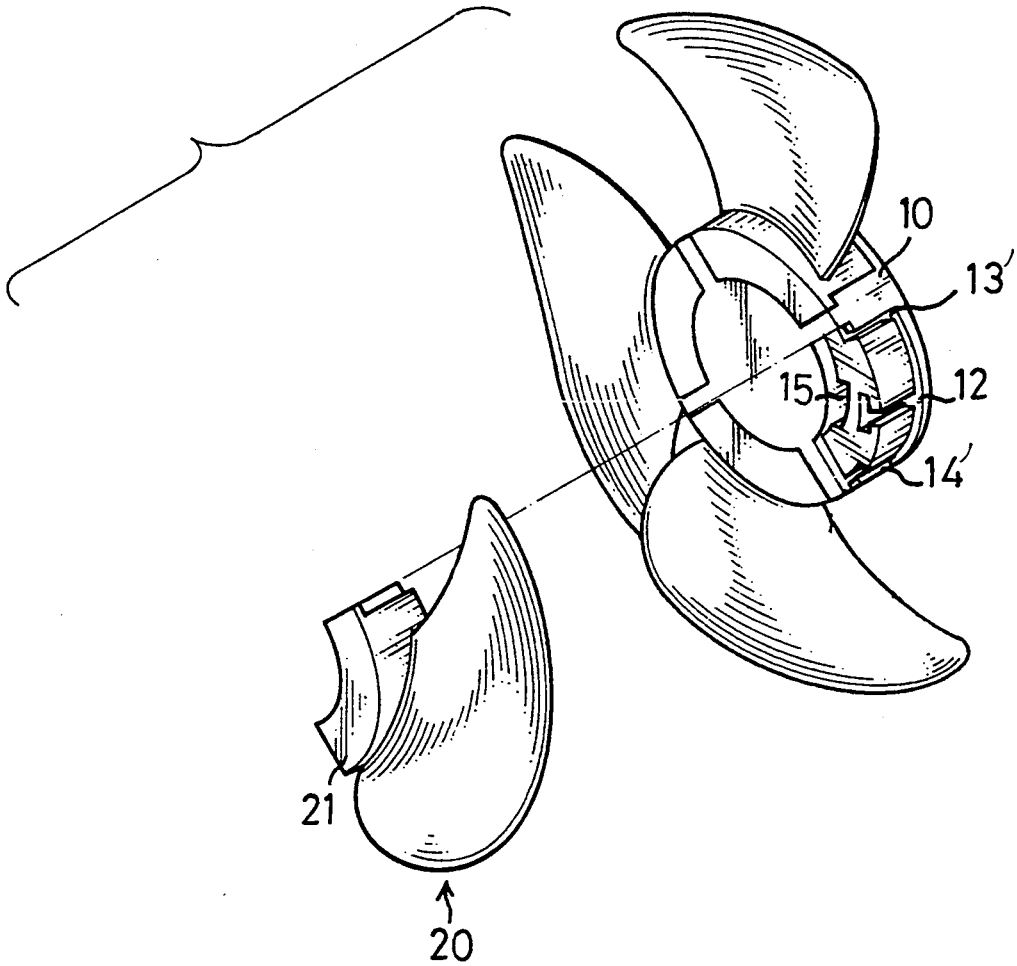
FIG. 5 is an exploded view of a fan in accordance with a second embodiment of the present invention.

FIGS. 5 and 6 show a second embodiment of the present invention which is similar to the first embodiment of the present invention shown in FIGS. 1–4 except for two L-shaped slots 13' and 14' and two L-shaped slides 24' and 25'. The second portion of the L-shaped slot 13' and the second portion of the L-shaped slot 14' extend away from each other. The L-shaped slide 24' is engaged in the L-shaped slot 14'. The L-shaped slide 25' is engaged in the L-shaped slot 13'.

Figure 8:
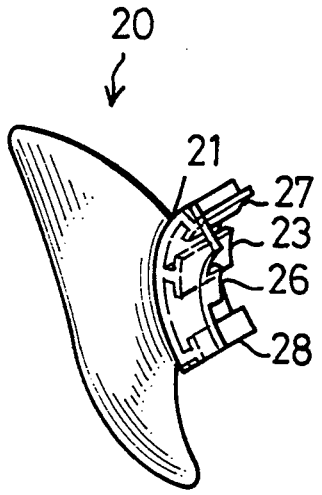
FIG. 8 is a perspective view of a fin in accordance with the third embodiment of the present invention.
Figure 7:
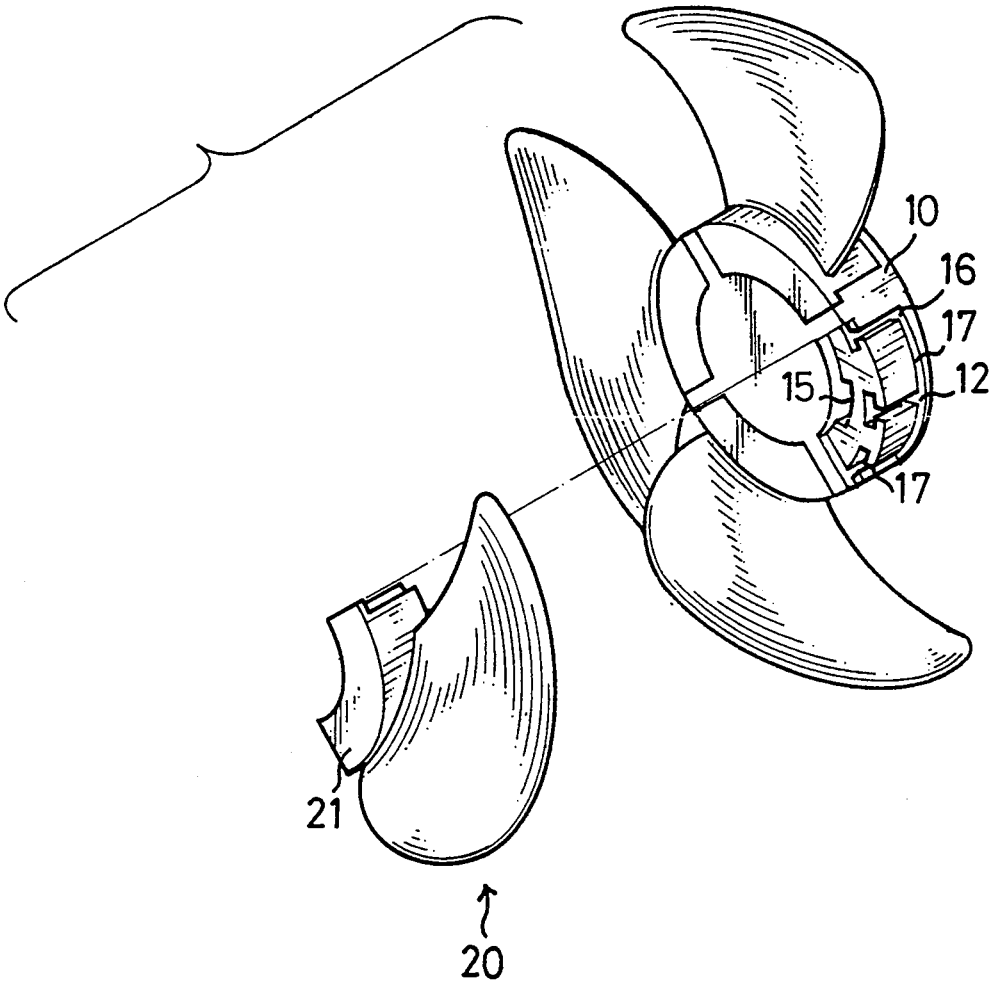
FIG. 7 is an exploded view of a fan in accordance with a third embodiment of the present invention.

FIGS. 7 and 8 show a third embodiment of the present invention which is similar to the first embodiment of the present invention shown in FIGS. 1–4 except for two T-shaped slots 16 and 17 and two T-shaped slides 27 and 28. The T-shaped guide 27 is engaged in the T-shaped slot 17. The T-shaped guide 28 is engaged in the T-shaped slot 16.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

What is claimed is:

1. A fan comprising a plastic hub linked to several plastic fins which are formed in a mold wherein the hub comprises several female engaging devices each comprising a T-shaped slot formed in the hub and two L-shaped slots formed in the hub, wherein the fins each comprise a male engaging device comprising a T-shaped slide and two L-shaped slides formed on a corresponding fin, whereby the T-shaped slide is engageable in the T-shaped slot and each L-shaped slide is engageable in a corresponding L-shaped slot.

2. A fan in accordance with claim 1 wherein each L-shaped slot comprises a first portion radially extending in the hub and a second portion perpendicularly extending from the first portion.

3. A fan according to claim 2 wherein the second portions of the L-shaped slides extend toward each other.

4. A fan according to claim 2 wherein the second portions of the L-shaped slides extend away from each other.

5. A fan comprising a plastic hub linked to several plastic fins which are formed in a mold wherein the hub comprises several female engaging devices each comprising three T-shaped slots defined in the hub, wherein the fins each comprise a male engaging device comprising three T-shaped slides formed on a corresponding fin, whereby each T-shaped slide is engageable in a corresponding T-shaped slot.

* * * * *